United States Patent [19]

Nagashima

[11] 4,419,006

[45] Dec. 6, 1983

[54] IMAGE PROCESSING APPARATUS UTILIZING DIGITAL DISPLAY MEANS

[75] Inventor: Nao Nagashima, Tokyo, Japan

[73] Assignee: Canon Kabushiki Kaisha, Tokyo, Japan

[21] Appl. No.: 309,381

[22] Filed: Oct. 7, 1981

[30] Foreign Application Priority Data

| | | | |
|---|---|---|---|
| Oct. 15, 1980 | [JP] | Japan | 55-144803 |
| Oct. 15, 1980 | [JP] | Japan | 55-144809 |
| Oct. 15, 1980 | [JP] | Japan | 55-144811 |

[51] Int. Cl.[3] ..... G03G 15/00

[52] U.S. Cl. ..... 355/14 R; 355/14 C

[58] Field of Search ..... 355/14 R, 14 C, 3 R

[56] References Cited

U.S. PATENT DOCUMENTS

| | | | |
|---|---|---|---|
| 4,343,036 | 8/1982 | Shimizu et al. | 355/14 C |

FOREIGN PATENT DOCUMENTS

| | | | |
|---|---|---|---|
| 54-36732 | 3/1979 | Japan | 355/14 C |
| 54-50329 | 4/1979 | Japan | 355/14 C |
| 2041572 | 9/1980 | United Kingdom | 355/14 C |

*Primary Examiner*—R. L. Moses

*Attorney, Agent, or Firm*—Fitzpatrick, Cella, Harper & Scinto

[57] ABSTRACT

An image forming apparatus which includes a display device for displaying a numerical value related to the number of image formation operations is also capable of displaying a measured or calculated value associated with the operating condition of the image forming apparatus.

10 Claims, 8 Drawing Figures

CONTROL TIMING SIGNAL
50
VREF
D/A CONVERTER
51
52
53
45
HIGH VOLTAGE PRIMARY TRANS
22
HIGH VOLTAGE SECONDARY TRANS
23
46
16
CVR
47
DEVELOPMENT BIASING TRANS
25
48
+V
LD1
LD2
LD3
LD4
LD5
LD6
LD7
DISPLAY DRIVER
60
61
61-1 61-2 61-3 61-4

IMAGE PROCESSING APPARATUS UTILIZING DIGITAL DISPLAY MEANS

BACKGROUND OF THE INVENTION

1. Field of the Invention

The present invention relates to an image processing apparatus provided with a digital data processing apparatus.

2. Description of the Prior Art

In a complicated apparatus such as copying machine there are provided a plural number of circuits. Many signals are transmitted to and from the circuits. For such apparatus, it is a common practice in the art to allot one signal line to one operation. Therefore, the number of signal lines required increases with increasing the complexity of operations then required. Increase of the number of signal lines makes complicated the wirings between circuits as well as the structure of interface circuits. The problems of high cost and low reliability are caused thereby.

To decrease the number of signal lines necessary between circuits, it has already been proposed and practically accepted to use a signal coding circuit at the signal output side and a signal decoding circuit at the signal input side. However, it has been found that this solution also has many drawbacks. As coding and decoding circuits are required, it also makes the circuits of the apparatus complicated so much. When man wishes to modify the specification of signals used in the apparatus, it is required to change the circuit completely. This is time and labour consuming.

Furthermore, to conduct adjustment and inspection of every unit circuit, the signal lines between the circuits have to be removed and also a particular signals has to be externally introduced into the circuit to prevent any malfunction of the circuit during the adjustment and inspection. Therefore, the service man who has a charge of such apparatus in the market has been compelled to consume a long time and a great labour for adjustment and inspection.

SUMMARY OF THE INVENTION

Accordingly, it is an object of the invention to overcome the above drawbacks by using a digital computer such as a one chip microcomputer which has been rapidly popularized in recent years.

More particularly, it is an object of the invention to simplify the circuits and signal lines in such apparatus in respect of reception and transmission of signals between circuits.

Other and further objects, features and advantages of the invention will appear more fully from the following description taken in connection with the accompanying drawings.

DETAILED DESCRIPTION OF PREFERRED EMBODIMENTS

Figure 1:
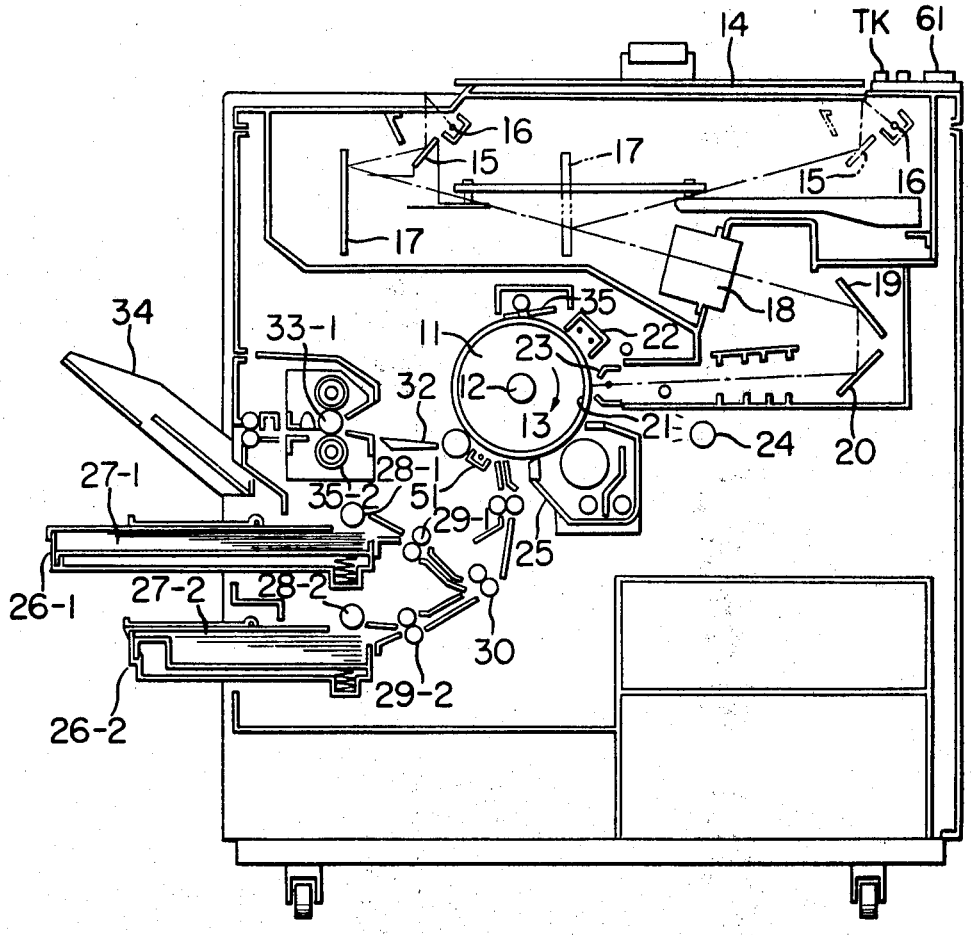
FIG. 1 is a schematic sectional view of a copying apparatus in which the present invention is embodied.

Referring to FIG. 1, the copying apparatus includes a drum 11 the surface of which is composed of a three layer photosensitive medium formed using CdS photoconductive material. The photosensitive drum 11 is mounted on a shaft 12 rotatably about the shaft. When a copy instruction is issued, the drum starts rotating in the direction of arrow 13.

14 is an original table glass plate on which an original is placed. When the drum 11 reaches a determined rotational position, the original is illuminated by an illumination lamp 16 integrally formed with a first scanning mirror 15. The reflected light from the original is scanned by the first scanning mirror 15 and a second scanning mirror 17 which is moved at a half speed of the first one. Since the first and second scanning mirrors 15 and 17 move at the speed ratio of $1:\frac{1}{2}$, the scanning on the original is carried out with the optical path length before a lens 18 being kept constant.

The reflected light image is focused on the drum 11 at the exposure part 21 through the lens 18, a third mirror 19 and a fourth mirror 20.

The drum 11 is at first charged by a primary charger 22 (for instance, with positive charge +) and then, at the exposure part 21, the drum is slit exposed to the image illuminated by the lamp 16. At the same time, discharging is carried out on the drum surface by a discharger 23 with AC or with the opposite polarity (for instance, −) to the primary charge. Thereafter, the drum is subjected to a whole surface exposure by a whole surface exposure lamp 24 so as to form a high contrast electrostatic latent image on the drum 11. The electrostatic latent image formed on the photosensitive drum is then visualized as a toner image by a developing device 25.

A transfer sheet 27-1 or 27-2 is fed into the machine from paper cassette 26-1 or 26-2 by a paper feed roller 28-1 or 28-2. The transfer sheet is directed to the drum 11 through a first register roller 29-1 or 29-2 and then through a second register roller 20. The timing of paper feed to the drum is adjusted at first roughly by the first register roller and then precisely by the second one.

The transfer sheet 27 passes through the space between the drum surface and a transfer charger 31, and during the time the toner image is transferred onto the transfer sheet from the drum.

After transferring, the transfer sheet is guided to a conveyor belt 32 which transports the transfer sheet to a pair of fixing rollers 33-1 and 33-2 where the toner image is fixed to the sheet under the action of pressure and heat. After fixing, the transfer sheet is discharged into a tray 34.

On the other hand, after transferring, the drum 11 enters a cleaning station where the drum surface is cleaned up by a cleaning device 35 formed on an elastic blade. After cleaning, the drum is further advanced to the next cycle of operation.

In FIG. 1, ten keys (numeral keys of 0 to 9) are generally designated by TK. A numeral value put in by the ten key TK is displayed on a display unit 61. The copying apparatus repeats the above original scanning many times corresponding to the input numerical value n. Thus, n sheets of copy are produced.

Figure 2A:
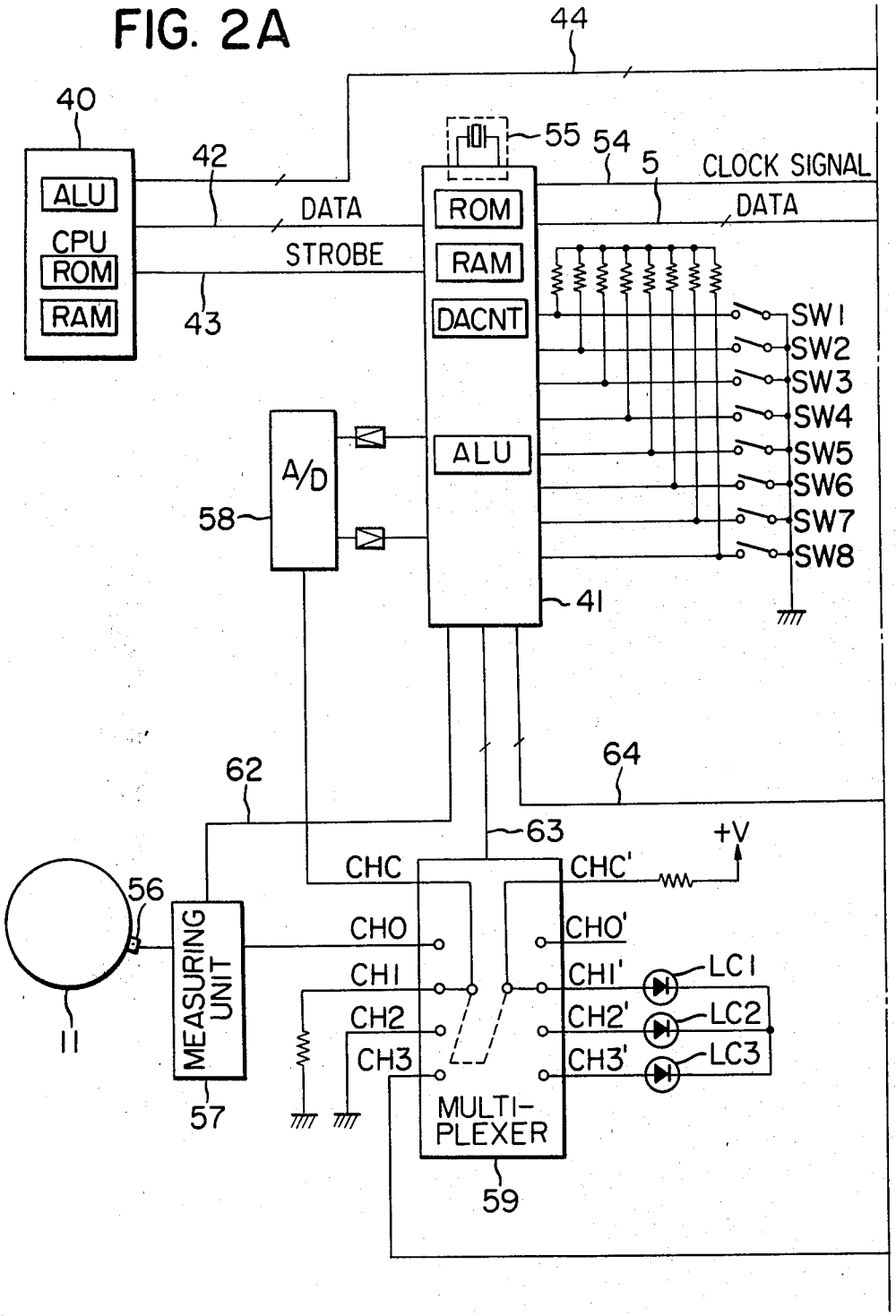
FIG. 2 is a circuit diagram showing the control circuit in the copying apparatus.
Figures 2, 2A, 2B:
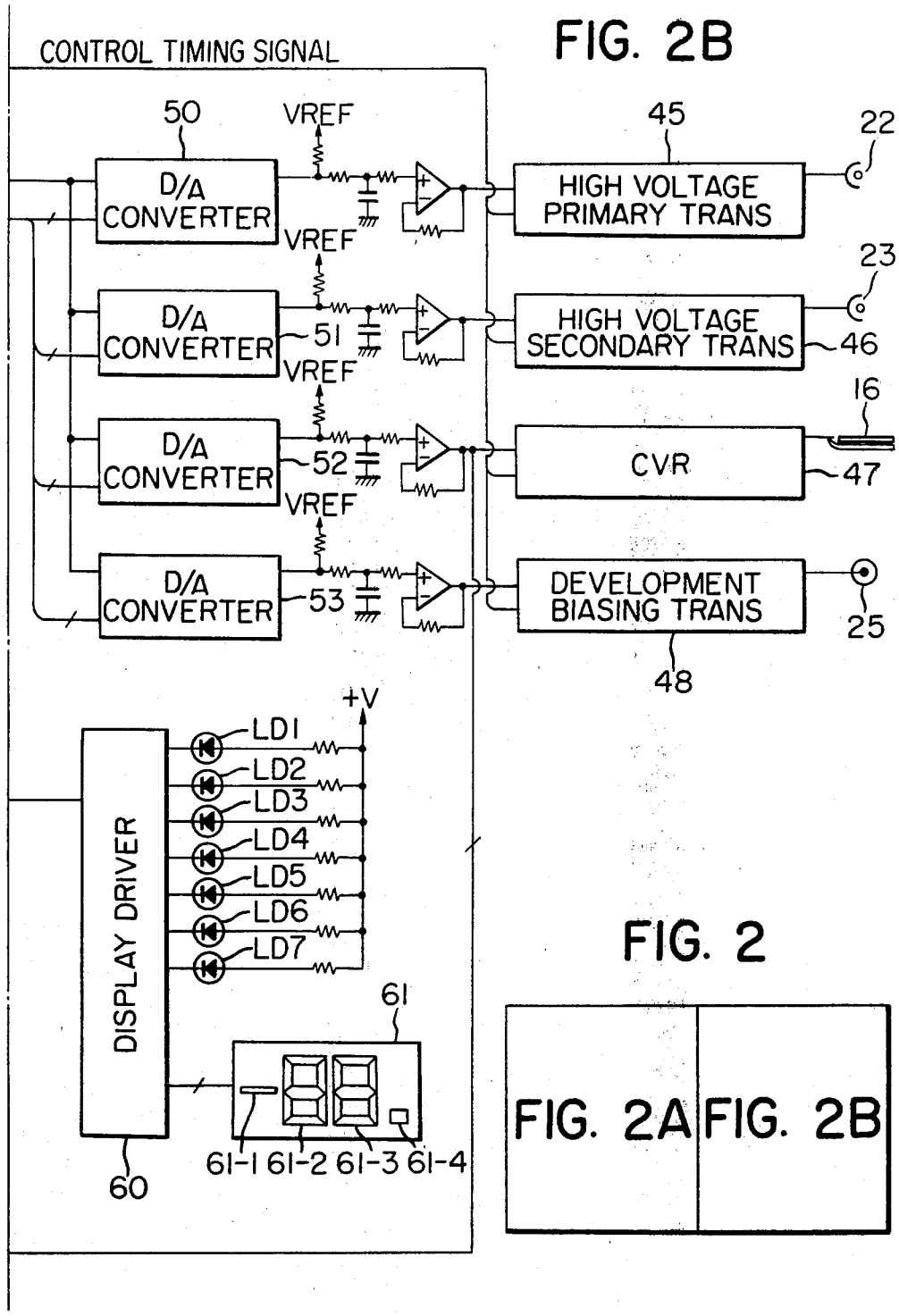

FIG. 2 shows the control circuit of the above copying apparatus.

40 and 41 are master and slave microcomputers of which the master computer 40 controls the copying process whereas the slave computer 41 is used to set conditions for the processing units and display the set conditions. The master and slave computers are connected by two signal lines 42 and 43. The signal line 42 is a line through which data are sent out from CPU 40 and the other signal line 43 is a line through which strobe signals are sent out from CPU 40. CPU 40 has also a signal line 44 through which the CPU 40 sends out various timing signals for controlling the respective operations of process units such as a high voltage primary transformer 45 for supplying a high voltage to the primary charger 22, a high voltage secondary transformer 46 for supplying a high voltage to the discharger 23, a lamp circuit 47 for the illumination lamp 16 and a development biasing transformer 48 for applying a development bias to the developing device 25.

These process units 45–48 are so formed as to put out voltages corresponding to the outputs of digital-analog converters (D/A converters) 50–53. To these D/A converters digital data are applied from CPU 41 through signal line 59.

CPU 41 is provided with a clock generator 55. The clock signal generated from the generator 55 is used not only as clock for CPU 41 itself but also as clock source for above D/A converters 50–53 which are of clock synchronous type. To this end, the clock signals are supplied to D/A converters 50–53 through signal line 54. The clock generator 55 is, therefore, used to drive not only CPU 41 but also D/A converters 50–53. This arrangement makes it possible to reduce the number of parts required for the circuit and also to improve the reliability of the apparatus.

Designated by 56 is a sensor for measuring the surface potential of the drum 11. The output of the sensor 56 is connected to the channel 0 (CH 0) of a multiplexer 59 through a measuring unit 57. The measuring unit 57 applies the measured potential to the multiplexer when a sensor driving signal is applied to the measuring unit from CPU 41 through signal line 62. The multiplexer 59 has four channels 0 to 3. O (V) potential is applied to channel CH 1 and −E(V) is applied to channel CH 2. Applied to channel CH 3 is the output voltage of the lamp circuit. Any one of channels CH 0 to CH 3 is selected and the selected analog signal is applied to A/D converter 58. The digital signal obtained by this converter is introduced into CPU 41.

Channels CH 1'–CH 3' are provided corresponding to above channels CH 1–CH 3. These channels CH 1'–CH 3' have light emitting diodes LC1–LC3 respectively. When the multiplexer 59 selects one of the channels CH 1–CH 3, one of the light emitting diodes LC1–LC3 corresponding to the selected channel lights up to let the operator know which channel is selected.

The operation of multiplexer 59 is controlled by the control signal applied thereto from CPU 41 through signal line 63.

Designated by 60 is a display driver which forms display signals in response to the signals transmitted through signal line 64. The display driver 60 controls the program execution display by seven light emitting diodes LD1–LD7 as well as the numeral display by the display unit 61.

Of the seven LED, LD1 lights up during the time when the apparatus is executing a program for reading the strong light given by a blank exposure and calculating a surface potential control value from the value of the blank exposure light. LD2 is lighting during the time of the apparatus being in execution of a program for calculating a surface potential control value from the dark portion potential on the drum 11. LD3 and LD4 light up during the execution of a program for calculating a surface potential control value from the bright portion potential on the drum. LD5 is lighting during the time of a strobe signal being on the signal line 43. LD6 is lighting during the time when the apparatus is executing a program of minified copy making mode. LD7 lights up when the apparatus is executing a post rotation program (which is the process for further rotating the drum after transferring the formed toner image).

The display unit 61 is composed of a minus display segment 61-1, pattern display segments 61-2 and 61-3 for displaying the numerical values from 0 to 9 and a dot segment 61-4. The display on the display unit 61 can be made in various display forms.

For example, when a surface potential in three digits (in this case, the potential is expressed in 5 V), the segment 61-2 is used to represent a hundreds digit, the segment 61-3 to represent a tens digit and the segment 61-4 is used as the position of units. When the segment 61-4 is lighting, it is regarded as a representation of 5. Therefore, 215 (V) may be displayed by making 21 displayed on the segments 61-2 and 61-3 and further lighting the segment 61-4 on.

Switches SW1–SW8 connected to CPU 41 are control instruction switches. When SW1 is On, it gives an instruction to set self-diagnosis mode (however, the content of the self-diagnosis is determined by a combination of SW6–SW8). When the switch SW1 is Off and a strobe signal is appearing on the signal line 43 and also data signal is being applied on the signal line 42, then it gives an instruction to control the apparatus in accordance with the applied data signal. When SW1 is Off and no strobe signal is appearing on the signal line 4, then the apparatus executes an instruction determined by the combination of switches SW6–SW8.

Even if any strobe signal and data signal are applied during the time of SW1 being On, the self-diagnosis is executed while neglecting the applied strobe signal and data signal.

SW2 is a switch for making a selection as to whether potential control (control on the outputs of the primary and secondary chargers) should be executed or not. If no potential control is selected, a standard value is put out.

SW3 is a switch for making a selection as to whether light quantity control (control on the original exposure lamp) should be carried out or not. When the selection is no light quantity control, a standard value is put out.

SW4 is a switch for making a selection as to whether development bias control should be executed or not. If not, then a standard value is put out.

SW5 is a switch for selecting the time interval at which data should be put out to the display and D/A converter during the self-diagnosis mode.

SW6–SW8 are used to represent a 3-bit numerical value. For example, when all of the three switches are turned Off, there is shown (0 0 0) which represents a numerical 0. When all the switches are turned On, there is shown (1 1 1) which represents a numerical 7.

Figure 3:
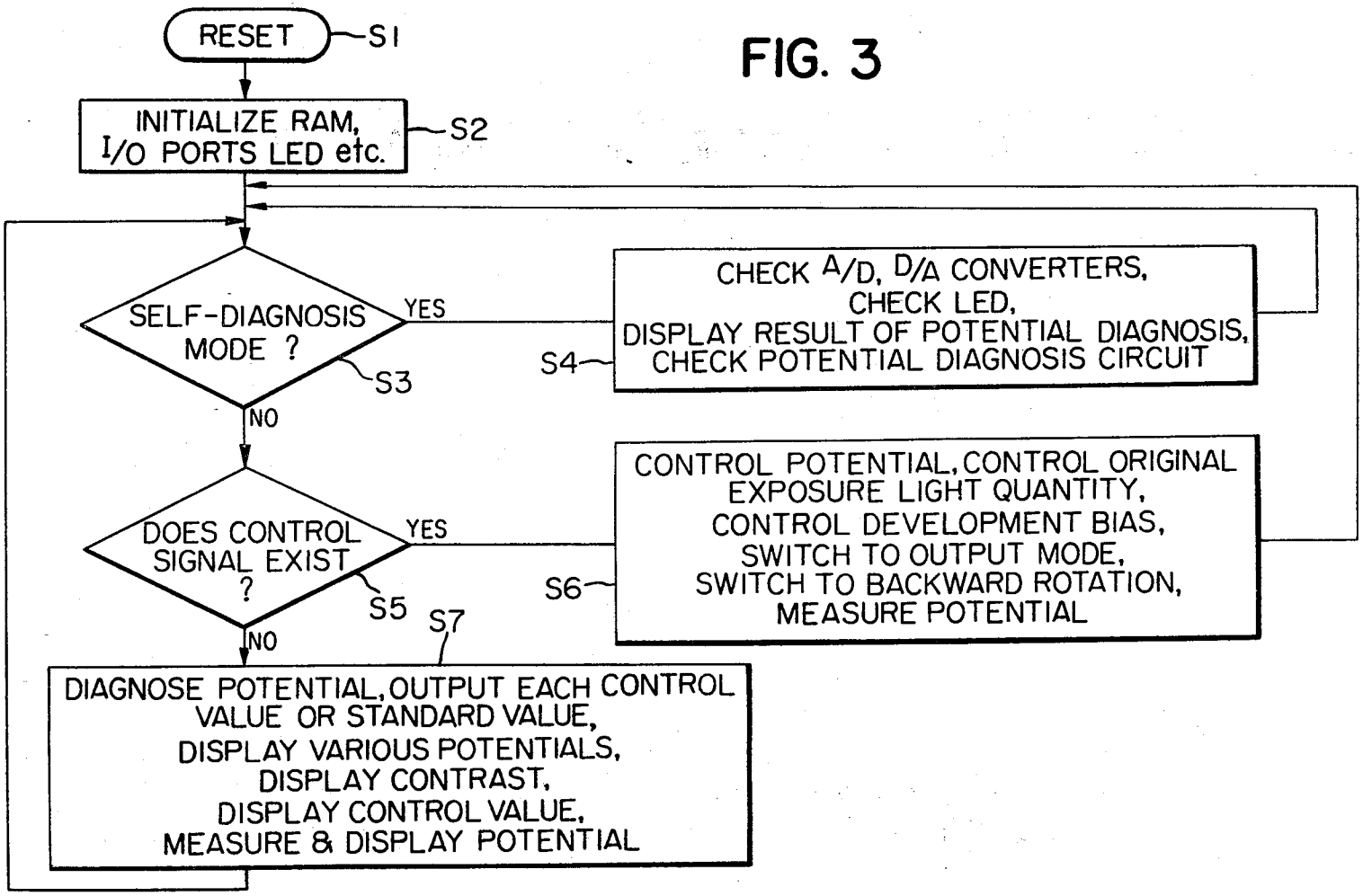
FIGS. 3 to 6 are flow charts for illustrating the manner of operation of the control circuit shown in FIG. 2.

FIG. 3 is a flow chart showing the operation of CPU 41 in FIG. 2.

By resetting at the first step S1, RAM, I/O ports, LED etc. in CPU 41 are initialized. After completing the initialization, it is discriminated at step S3 whether the mode is self-diagnosis mode or not (whether the switch SW1 is On or Off). When it is self-diagnosis mode (SW1 is On), the self-diagnosis is executed at step S4. If it is not self-diagnosis mode, it is discriminated at step S5 whether control signal exists or not (whether or not any strobe signal is transmitted through signal line 43). When control signal exists, the control mode is executed at step S6. When not, various data are put out at step S7.

Figure 4:
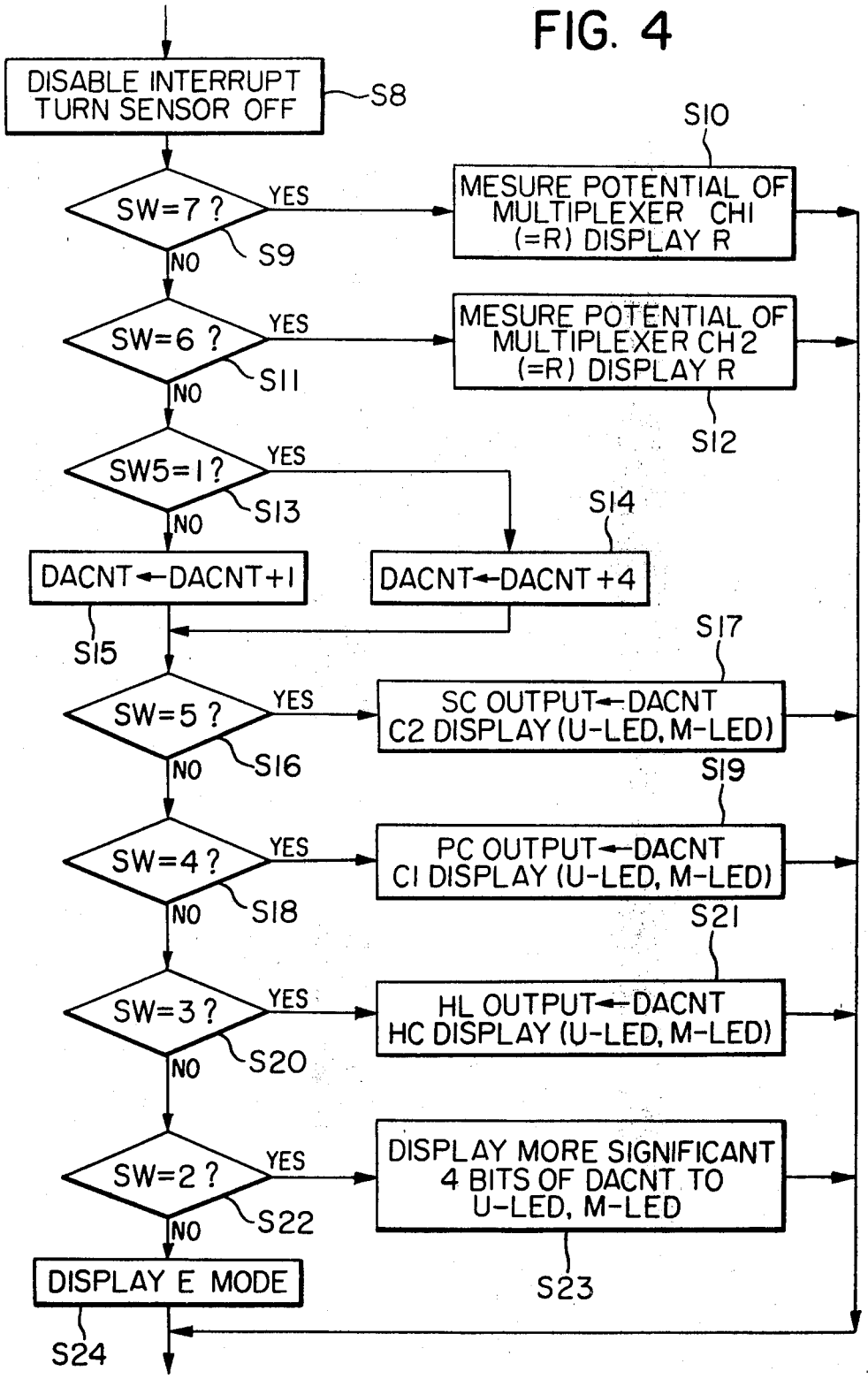

The self-diagnosis program is described in detail with reference to FIG. 4.

At step S8, interrupt is disabled and also the surface potential sensor 56 is turned Off. At the next step S9 it is discriminated whether the numerical value represented by switches SW6–SW8 is 7 or not. When it is 7, the common channel CHC is connected with channel CH1 by the multiplexer 59 to make the display unit 61 display the measured potential. The set value for this potential is 0 V. Therefore, if the displayed potential is at or about 0 V, the variable resistor (not shown) within A/D converter 58 must be adjusted to keep the potential within the range of set values.

If the numerical value is not 7, the step is advanced to S11 at which discrimination is made as to whether the numerical value is 6 or not. When it is 6, the multiplexer 59 connects the common channel CHC to channel CH2 to display the measured potential on the display unit 61. The standard potential −E(v) is confirmed by it.

If the numerical value is not 6, then the step is advanced to S13 at which discrimination is made as to whether the switch SW5 is On or Off. SW5 is a switch for determining the speed of level change for check at the following steps S17, S19, S21 and S23. When the switch SW5 is On, a counter DACNT takes a stepwise increment of 4 at a uniform speed to change the level at a higher speed. When SW5 is turned Off, the counter DACNT takes a stepwise increment of 1 to change the level at a lower speed.

The counter DACNT is a counter which returns to the initial value when it reaches a certain value. Consequently, the value counted by the counter increases gradually from the initial value at a uniform speed. When it reaches a certain value, the above operation is repeated again from the initial value.

The level change at a lower speed makes it possible to clearly examine the state of lighting of the segments in the display unit. Therefore, trouble in any of the segments, if occurred, can be discovered very easily.

At the next step S16, it is discriminated whether the numerical value represented by SW6–SW8 is 5 or not. when it is 5, checking of the primary high voltage is carried out. The check is made in order to ascertain whether the respective circuits are operating normally. To this end, the output of the counter DACNT is applied to D/A converter 50 and then the measuring unit measures the analog value obtained by conversion, the output of D/A converter 50 and the output or input of the high voltage primary transformer 45. As mentioned above, the count value of the counter DACNT is gradually increased up and when it reaches a certain value, the value is returned back to the initial value. The counter repeats the above operation of increasing the value gradually starting from the initial value.

For example, if the result of the above check indicates that the output of the D/A converter 50 is normal but the input signal to the high voltage primary is abnormal, the source of the abnormal input signal can be located very easily. In this case, from the result of the check it is easily determined that the trouble is in the circuit between the D/A converter 50 and the input terminal of the high voltage primary transformer.

In this manner, according to the embodiment of the invention, it can be easily determined only by switching over the switches which part of the circuit is in trouble. Therefore, the time required to check the base board in factory or the time required for service in market can be reduced to a great extent. Further, it needs no particular circuit. A very inexpensive inspection can be realized thereby. Upon this check, to confirm the content of the check, a combination of an alphabetical character C and a numeral 2, that is, C2 is displayed by the display segments 61-2 and 61-3.

If the numerical value represented by SW6–SW8 is not 5, then the step is advanced to S18 at which it is discriminated whether the numerical value is 4 or not. When it is 4, a checking of the secondary high voltage source is carried out in the same manner as at the above step S17 by gradually changing the input value to D/A converter 51. Similarly to the above, to confirm the content of the check, a symbol C1 is displayed by the display segments 61-2 and 61-3.

If it is not 4, then the step is advanced to S20 at which it is discriminated whether the numerical value is 3 or not. When it is 3, the lamp circuit is checked in the same manner as at the above step S17 by gradually changing the input value to D/A converter 52.

Similarly to the above, during the check, a symbol HC is displayed by the display segments 61-2 and 61-3 to represent the content of the check now being carried out.

If it is not 3, the step is advanced to S22 at which it is discriminated whether the numerical value is 2 or not. When it is 2, checking is carried out in the same manner as at the above step S17 by gradually changing the input value to D/A converter 53. At the same time, data of more significant 4 bits of the counter DACNT which is an 8-bit counter is displayed on the display unit 61. During the time, the display on the display unit 61 changes successively from −0 0. to −1 1., −2 2., . . . so on to check the operations of the display unit 61 and display driver 60. At the same time, change of the output of D/A converter 53 is also displayed. If the numerical value is not 2, namely if the numerical value represented by SW6–SW8 is 0 or 1, the step is advanced to S24 at which display is made in error mode. At the display in error mode, the result of potential diagnosis executed at the step S4 is displayed in the form of OH, EE or EA according to the contents of the display segments 61-2 and 61-3. This shows the operator whether there exists any error and, if exists, the kind of the occurring error. Therefore, the operator can easily discover the trouble.

The control step S6 in FIG. 3 will be described hereinunder more particularly with reference to FIG. 5.

The step S6 is executed when the switch SW1 is Off and a strobe signal is appearing on the signal line 43. The content of the control at this step is determined by the numerical value of 0–15 represented by the 4 bit coded signal appearing on the signal line 42. Therefore, at first it is discriminated at step S30 whether the data signal is 15 or not. When it is 15, mode 0.7 is set at step S31. More particularly, the soft ware flag is so changed as to produce such high voltage primary and secondary outputs corresponding to the magnification of 0.7 for minified copy. Similarly, when the data signal is 14 at step S32, mode 1 is set at the next step S33. Namely, the soft ware flag is so altered as to produce such high voltage primary and secondary outputs corresponding to unit (X1) magnification copy. In accordance with the soft ware flag changed at step 31 or 33, the necessary high voltage primary and secondary outputs are produced at the step S7.

Figure 5:
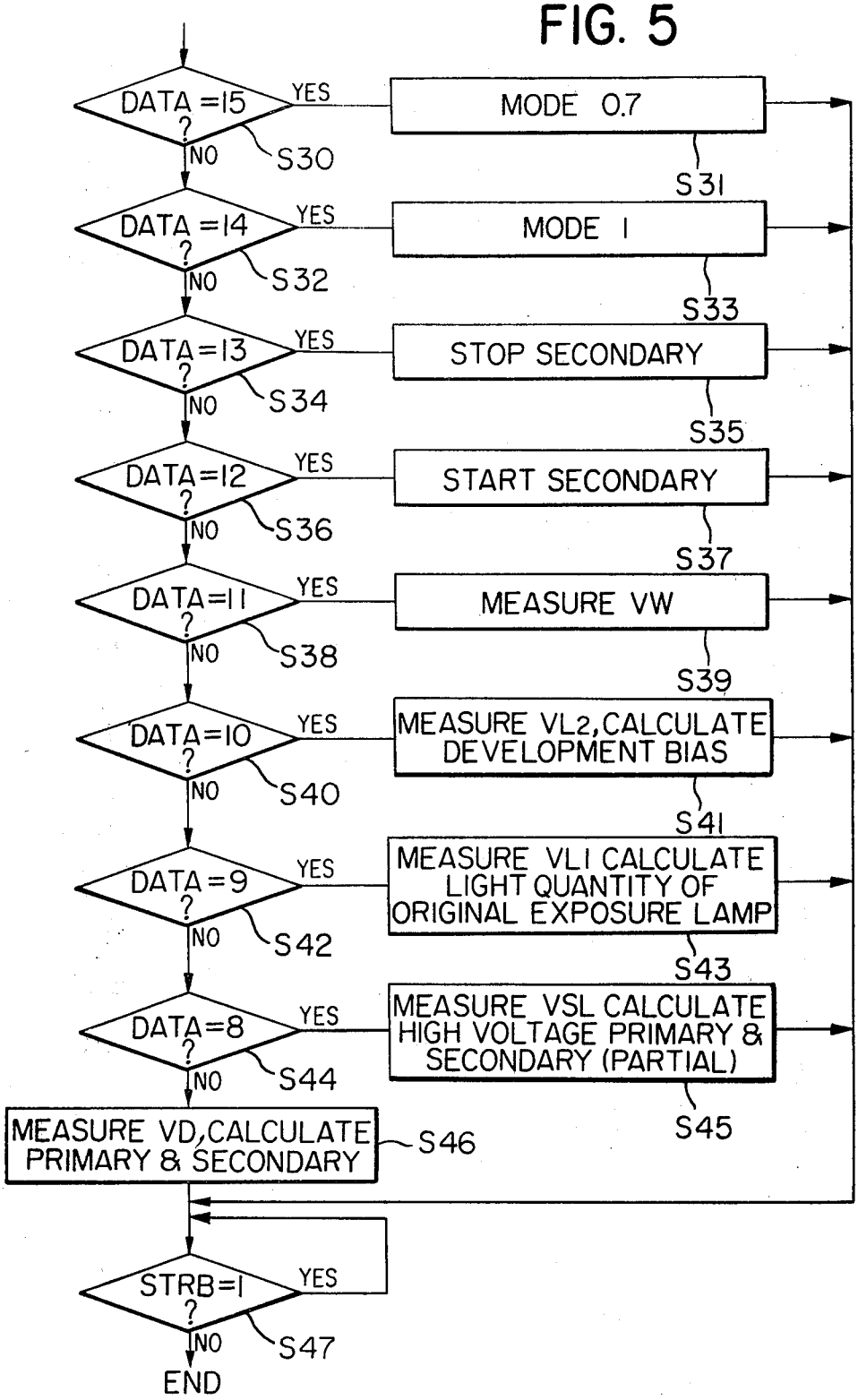

At the steps subsequent to the above, the control is carried out in the similar manner in accordance with the flow chart shown in FIG. 5. As to steps S35, S37, S39, S41, S43, S45 and S46, a further detailed description will be made hereinunder.

When data signal is 13 at step 34, the secondary weak soft ware flag is cleared off at the next step S35. In this position where the secondary weak soft ware flag is cleared, the high voltage primary and secondary outputs remain at a level for ordinary copying operation. When the secondary weak soft ware flag is set, the high voltage primary output is reduced to 0 and the high voltage secondary output is reduced to a low level. The drum is slowed down from rotation for copying to stop. During this phase of rotation, the charge remaining on the drum 11 is removed. This control is carried out at step S7 at which it is discriminated whether the secondary weak soft ware flag is set or not and, when it is set, the secondary weak output is produced.

When data signal is 12 at step S36, the secondary weak soft ware flag is set at step S37.

At the next step S38, it is discriminated whether data signal is 11 or not. When it is 11, Vw is measured at step 39 and the measured value is stored in memory. Vw denotes the potential of latent image formed on the drum by using a test chart or the like placed on the original table. In accordance with the operation of the main body of the machine, a measurement signal is transmitted to the slave CPU 41 from the master CPU 40 for sample holding.

Vw is used when the service man carries out an image adjustment in the market or for adjustment before delivery from the factory.

Vw is displayed on the display unit 61 when the later mentioned step S53 has been carried out.

When data signal is 10 at step S40, development bias setting potential $VL_2$ for determining the necessary development bias is measured and memorized at step S41. Also, at step S41 the necessary development bias is calculated from $VL_2$ and it is stored in memory. $VL_2$ is displayed on the display unit 61 when the later mentioned step S55 is executed. The determined development bias is put out at step S7.

At step S42 it is discriminated whether data signal is 9 or not. When it is 9, at step S43, an original exposure lamp setting potential $VL_1$ is measured which is used for determining the necessary light quantity of the original exposure lamp. The light quantity of original exposure lamp calculated from $VL_1$ is stored in memory also at step S43. $VL_1$ is displayed at step S57 and the calculated light quantity value of original exposure lamp is introduced into D/A converter at step S7.

At steps S45 and S46, the high voltage primary and secondary outputs are controlled and a calculation is carried out so as to converge the bright portion potential $V_{SL}$ and dark portion potential $V_D$ into the respective aim values.

When data signal is 8 at step S44, step S45 is executed. In all other case, namely when data signal is any of 0–7, step S46 is executed. By executing steps S45 and S46 in this order passing through the flow shown in FIG. 5 two times, the high voltage primary and secondary outputs are calculated and registered. The registered outputs are introduced into D/A converter at step 7. After completing the above described processing, the step is advanced to S47 at which it is confirmed that there is no strobe signal on the signal line 42.

This confirmation is conducted to prevent double execution of the above processing during one pulse of strobe signal.

The control step S7 in FIG. 3 is further described in detail hereinafter with reference to FIG. 6.

The step S7 is executed when SW1 is Off and there is no strobe signal. But the content of the step to be executed is different case by case according to the numerical value represented by the combination of switches SW6–SW8 which can represent any value within 0–7.

At first, it is discriminated at step S50 whether the numerical value is 7 or not. When it is 7, step S51 is carried out. At this step S51, a sensor driving signal is applied to the signal line 62 from CPU 41 to measure the surface potential. Also, the multiplexer 59 connects the channel CHO to CHC to display the measured surface potential on the display unit 61.

Figure 6:
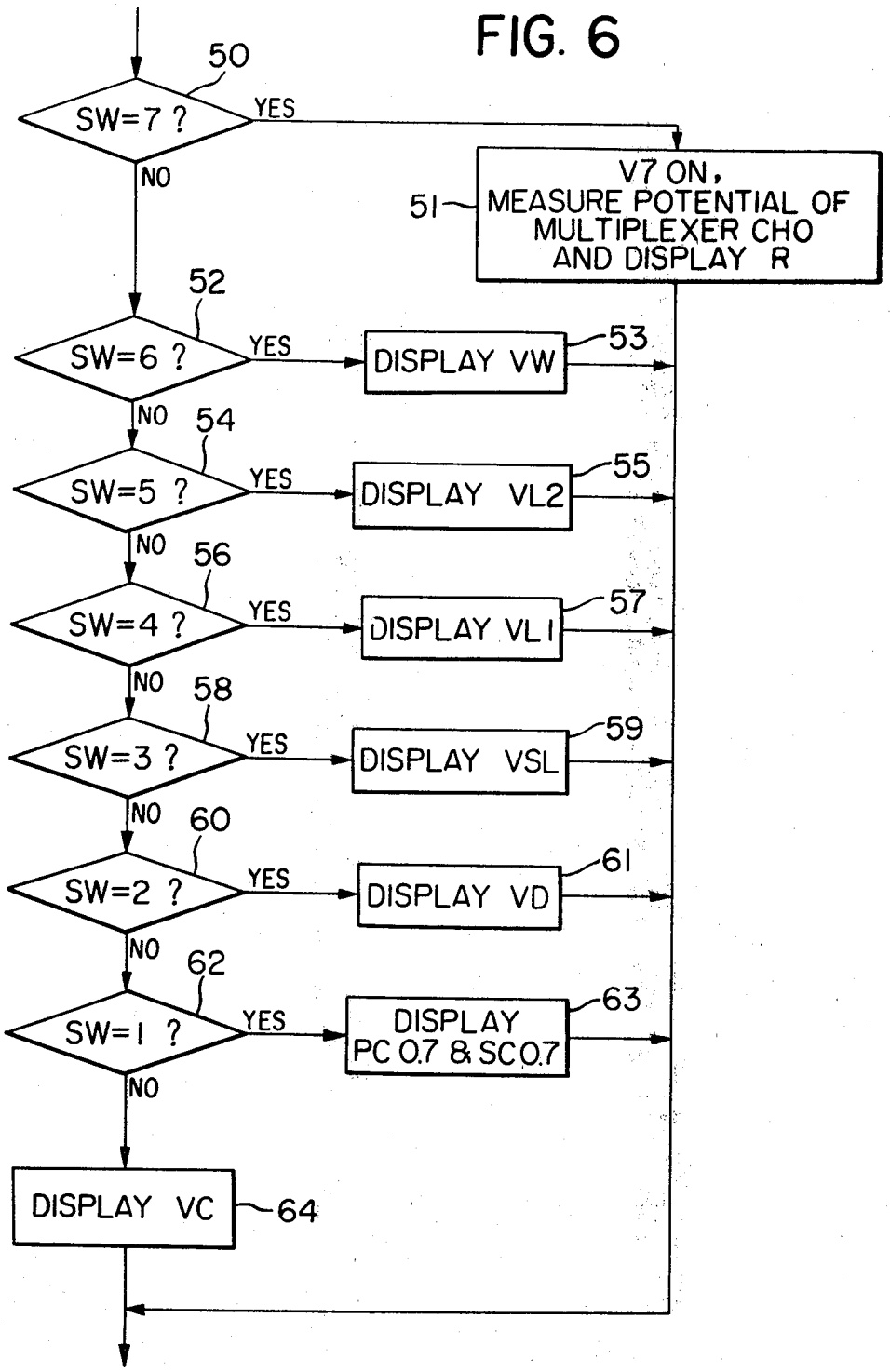

At the steps subsequent to the above, controls are carried out in similar manner to the above in accordance with the flow chart shown in FIG. 6. As to steps S53, S55, S57, S59, S61, S63 and S64, a further detailed description will be made hereinafter.

At steps S50, S52, S54, S56, S58, S60 and S62, discrimination is carried out regarding the numerical value of 0–7 represented by the combination of SW6–SW8 in the manner described above. It is determined by the discrimination at above every step whether or not the corresponding processing step S51, S53, S55, S57, S59, S61, S63 or S64 should be executed.

The step S51 is executed when the numerical value represented by the switches SW6-SW8 is 7. The potential sensor is actuated and the multiplexer 59 is switched over to the channel CHO so as to measure the surface potential on the drum 11 and also display the measured surface potential on the display unit 61. This step S51 is always executed so long as the switches are in the position to represent the numerical value 7. Therefore, the operator can read continuously from the display unit 61 the surface potential on the drum 11 which changes continuously with time. While watching the value on the display unit, the operator can conduct an adjustment of the potentiometer and a check on the operation of the apparatus.

At steps S53, S55, S57, S59 and S61, the above mentioned sample held potentials, Vw, $VL_2$, $VL_1$, $V_{SL}$ and $V_D$ are displayed respectively. Therefore, the operator can easily know from the display unit 61 the respective surface potentials found by the latest measurements. This enables the operator to judge it from the respective surface potential values whether or not the control is proceeding correctly.

At steps S63, PCO7 and SCO7 are displayed on the display unit 61. PCO7 is a value corresponding to 70% of the calculated high voltage primary output value and SCO7 is a value corresponding to 70% of the calculated high voltage secondary output value. By doing so, data of more significant 4 bits of each of PCO7 and SCO7 becomes a value of from 0 to 9 in relation to the internal numerical calculation. These more significant 4 bit data of PCO7 and SCO7 are displayed on the display segments 61-2 and 61-3 to let the operator know approximately changes of the high voltage primary and secondary outputs at the same time.

At step S64, $V_C=V_D-V_{SL}$ are calculated and the result thereof is displayed on the display unit 61. By reading $V_C$, that is, contrast potential on the display unit, the operator can judge it simply whether the control on the high voltage primary and secondary outputs is proceeding normally.

While the described embodiment represents the preferred form of the present invention, it is to be understood that modifications will occur to those skilled in the art without departing from the spirit of the invention. The scope of the invention is therefore to be determined solely by the appended claims.

What I claim is:

1. An image forming apparatus capable of displaying a numerical value comprising:

image forming means for forming images on a recording member, while driving an image forming member;

display means normally utilized for displaying a numerical value related to the number of image formation operations by said image forming means; and output means for producing a measured value of the state of said image forming member, said display means further capable of displaying said measured value as on alternative to the displaying of said numerical value related to the number of image formation operations.

2. An image forming apparatus as set forth in claim 1, wherein said display means comprises a plurality of numerical display units and one display element for indicating a predetermined number when illuminated.

3. An image forming apparatus as set forth in claim 1, further comprising a plurality of image forming members and selecting means for selecting a specific image forming member.

4. An image forming apparatus as set forth in claim 1, wherein said display means comprises a display unit having a plurality of bits and applying means for applying more significant bits to said display means when the number of bits of numerical value produced from said output means exceeds the number of said plurality of bits.

5. An image forming apparatus capable of displaying a numerical value comprising:

image forming means for forming images on a recording member, while driving an image forming member;

display means normally utilized for displaying a numerical value related to the number of image formation operations by said image forming means; and output means for producing a calculated numerical value for driving said image forming member and displaying said calculated value on said display means as an alternative to the displaying of said numerical value related to the number of image formation operations.

6. An image forming apparatus as set forth in claim 5, wherein said display means comprises a plurality of numerical value display units and a display element for indicating a predetermined number when illuminated.

7. An image forming apparatus as set forth in claim 5, further comprising a plurality of image forming members and selecting means for selecting a specific image forming member.

8. An image forming apparatus as set forth in claim 5, wherein said display means comprises a display unit having a plurality of bits and applying means for applying more significant bits to said display means when the number of bits of numerical value produced from said output means exceeds the number of said plurality of bits.

9. An image forming apparatus capable of displaying a numberical value comprising:

image forming means for forming images on a recording member;

display means normally utilized for displaying a numerical value of a plurality of bits related to the number of image formation operations by said image forming means;

data forming means for forming numerical value data capable of being displayed by said display means as an alternative to displaying the numerical data relating to said number of image formation operations; and output means for producing more significant bits of numerical value data on said display means when the number of bits of numerical value data formed by said data forming means exceeds the number of bits of said display means.

10. An image forming apparatus capable of displaying a numerical value comprising:

image forming means for forming images on a recording member;

display means normally utilized for displaying a numerical value related to the number of image formation operations by said image forming means;

output means for producing a stepwise changing signal for display on said display means for checking said display means said stepwise changing signal being displayed as an alternative to the display of said numerical value relating the number of image formation operations; and selecting means for selecting whether or not said output means should be driven.

* * * * *

UNITED STATES PATENT AND TRADEMARK OFFICE

CERTIFICATE OF CORRECTION

PATENT NO. : 4,419,006

DATED : December 6, 1983

INVENTOR(S) : NAO NAGASHIMA

It is certified that error appears in the above-identified patent and that said Letters Patent is hereby corrected as shown below:

COLUMN 1

Line 11, after "as" insert --a--.

Line 29, delete "so much";
"man" should read --one--.

Line 35, "signals" should read --signal--.

Line 39, delete "a".

COLUMN 4

Line 22, delete "on".

COLUMN 5

Line 3, "not" should read --non-existent--.

COLUMN 6

Line 35, "the" should read --that-- (first occurrence).

Line 48, before "exists" insert --one--.

COLUMN 7

Line 62, "case" should read --cases--.

COLUMN 8

Line 29, "above every" should read --each such--.

UNITED STATES PATENT AND TRADEMARK OFFICE

CERTIFICATE OF CORRECTION

PATENT NO. : 4,419,006

DATED : December 6, 1983

INVENTOR(S) : NAO NAGASHIMA

It is certified that error appears in the above-identified patent and that said Letters Patent is hereby corrected as shown below:

COLUMN 8

Line 51, delete "it".

Line 64, before "changes" insert --the--.

COLUMN 9

Line 1, delete "it".

CLAIM 1

Line 13, "on" should read --an--.

CLAIM 5

Line 9, "output" should begin a new paragraph.

CLAIM 9

Line 2, "numberical" should read --numerical--.

UNITED STATES PATENT AND TRADEMARK OFFICE

CERTIFICATE OF CORRECTION

PATENT NO. : 4,419,006

DATED : December 6, 1983

INVENTOR(S) : NAO NAGASHIMA

It is certified that error appears in the above-identified patent and that said Letters Patent is hereby corrected as shown below:

CLAIM 10

Line 12, after "relating" insert --to--.

Signed and Sealed this

*Seventeenth* Day of *April 1984*

[SEAL]

*Attest:*

GERALD J. MOSSINGHOFF

*Attesting Officer* *Commissioner of Patents and Trademarks*